United States Patent [19]

Salaun, Jr. et al.

[11] Patent Number: 4,845,813

[45] Date of Patent: Jul. 11, 1989

[54] ROLLER DRAFTER, PROCESS OF USE, AND PRODUCTS PRODUCED THEREBY

[75] Inventors: Harold L. Salaun, Jr., Metairie; Craig L. Folk, New Orleans, both of La.

[73] Assignee: United States of America, as represented by the Secretary of Agriculture, Washington, D.C.

[21] Appl. No.: 133,477

[22] Filed: Dec. 15, 1987

[51] Int. Cl.[4] ..... D01H 5/74

[52] U.S. Cl. ..... 19/258; 19/261

[58] Field of Search ..... 19/128, 236, 242, 244, 19/258, 260, 261, 269, 293, 0.39; 28/240, 244; 57/315, 316, 317

[56] References Cited

U.S. PATENT DOCUMENTS

| | | | |
|---|---|---|---|
| 687,770 | 12/1901 | McGowan | 19/269 |
| 2,219,666 | 10/1940 | Solanas | 19/236 X |
| 2,335,108 | 11/1943 | Clapperton et al. | 19/293 X |
| 2,458,852 | 1/1949 | Helland | 19/269 X |
| 2,592,153 | 4/1952 | Johnson et al. | 28/168 |
| 2,597,278 | 5/1952 | Arundale et al. | 19/260 X |
| 2,731,788 | 1/1956 | Donaldson | 28/168 X |
| 2,734,231 | 2/1956 | Boer | 19/128 |
| 4,347,647 | 9/1982 | Brown et al. | 19/128 |
| 4,356,690 | 11/1982 | Minorikawa et al. | 28/240 X |
| 4,547,936 | 10/1985 | Bacchio | 19/258 |

FOREIGN PATENT DOCUMENTS

| | | | |
|---|---|---|---|
| 566740 | 5/1923 | France | 19/258 |
| 347842 | 4/1937 | Italy | 19/260 |
| 4532366 | 10/1970 | Japan | 19/0.39 |

OTHER PUBLICATIONS

Salaun, H. L. et al., "No-Twist Cotton Yarn Made from Card Web", Textile Res. Journal, vol. 50, No. 2, pp. 115-119, Feb. 1980.

Salaun, H. L. et al., "The SRRC Experimental No-Twist Yarn System", Journal of Coated Fabrics, vol. 10, pp. 98-106, Oct. 1980.

Salaun, H. L. et al., "An Improved SRRC No-Twist Yarn System", Textile Research Journal, vol. 53, No. 2, Feb. 1983, pp. 103-108.

Salaun, H. L. et al., "The SRRC No-Twist Yarn System", Am. Textiles Rep. Bull., 9(11), pp. 36-40, Nov. 1980.

Louis, Gain L. et al., "X" Direction Filament-Wrapped Yarn, Textile Res. Journal, vol. 56, No. 3, pp. 161-163, Mar. 1986.

Simpson, J. et al., "A Method and Instrument for Measuring Fiber Hooks . . . " Textile Res. Journal, vol. 40, No. 10, pp. 956-957, Oct. 1970.

*Primary Examiner*—Werner H. Schroeder
*Assistant Examiner*—Sara M. Current
*Attorney, Agent, or Firm*—David Sadowski; M. Howard Silverstein

[57] ABSTRACT

Disclosed is a new roller drafter for drafting and aligning fibers in a strand or strip of card web e.g. for producing filament-wrapped yarn. The improvements include, increasing (in the direction of strip or strand movement) the distances between nips of adjacent pairs of rolls and optionally increasing in said direction of strip or strand movement the outer diameters of each pair of rolls. Also disclosed are, a process utilizing said roller drafter (optionally with filament wrapping), and a drafted strand or strip and a wrapped yarn which are products of the present invention.

27 Claims, 3 Drawing Sheets

ROLLER DRAFTER, PROCESS OF USE, AND PRODUCTS PRODUCED THEREBY

BACKGROUND OF THE INVENTION

1. Field of the Invention

The present invention pertains to: a new type of fiber roller drafter for drafting strands or strips of fibers, for example, for subsequent yarn formation; a process for producing a drafted strand or strip or a wrapped yarn utlizing said drafter; and a drafted strand or strip or wrapped yarn produced therefrom. This invention permits filament wrapped yarn of sufficient elongation to be used as warp yarn in weaving, to be successfully produced directly from a strand or strip of card web. Making wrapped yarn directly from the card affords the advantages of elmininating conventional processing steps such as double-drawing, roving, spinning, rewinding, and slashing. Savings from eliminating said processing steps offsets the cost of the wrapping filament.

2. Description of Prior Art

Filament wrapped yarn is normally produced from expensive high production machines, but converter ring frames can also produce filament wrapped yarn, though at a much slower production rate. One of the advantages of wrapped yarn is its potential to eliminate sizing when used as warp yarn in weaving. After the original United States Department of Agriculture Southern Regional Research Center (SRRC) no-twist yarn system, as described in : Brown, Rober S., Salaun, Harold L., Jr., Louis, Gain L. Apparatus for Making No-Twist Yarn, U.S. Pat. No. 4,347,647, Sept. 7, 1982, Salaun, H. L., Brown., R. S., and Louis, G. L., No-Twist Yarn Made From Card Web, Textile Res. J. 50(2), 115–119 (1980), and Salaun, H. Jr., and Lewis, Gain L., "The SRRC no-twist yarn system", Journal of Coated Fabrics 10, 98–105 (1980); was developed, much effort was spent in refining the system to run at high speed and to produce a yarn with high elongation for fabric production. Many mechanical devices were designed and built for more effectively drafting a strip of card web into fiber strands, as for example described in Salaun, Harold L., and Lewis, Gain L., "An Improved SRRC no-twist yarn system", Textile Research Journal 53, 103–108 (1983).

SUMMARY

Disclosed is a new drafting device for continuously drafting strands or strips of staple textile fibers (e.g. to uniformly draft and align fibers in a strip of carb web for subsequent yarn formation) including pairs of rolls of gradually increasing nip spacing. The process of the instant invention includes drafting a strand or strip with said rolls of gradually increasing nip spacing, optionally followed by wrapping the drafted strand or strip with a wrapping fiber. An advantage of the instant invention over conventional drafting is in regard fiber control. In conventional roller drafting, all rolls are essentially the same size so that the nip to nip spacings for all zones must be at least equal to the length of the longest fiber to prevent fiber breakage. Thus, in each zone, particularly in the first zone, there are many fibers due to their crimp or poor alignment to the central axis of the strand, that are not controlled by either pair of rolls. The speeds of these floating fibers are determined by random frictional forces with adjacent fiber and are prone to move forward in clumps. This irregular movement causes a succession of thick and thin places called drafting waves which reduce the quality of the drafted strand or strip. However, in the drafting of the present invention, because the gradual increase in nip to nip distance closely approximates the increase in fiber projected mean length (PML) as the strip or strand is drafted, the number of floating fibers is minimized and a superior drafted strand is produced. Another advantage of the present invention over conventional production methods, is the production of filament wrapped yarn directly from the card, e.g. the two drawing, roving, spinning and rewinding stage can be eliminated, thus reducing processing costs.

DETAILED DESCRIPTION OF THE INVENTION

Figure 1:
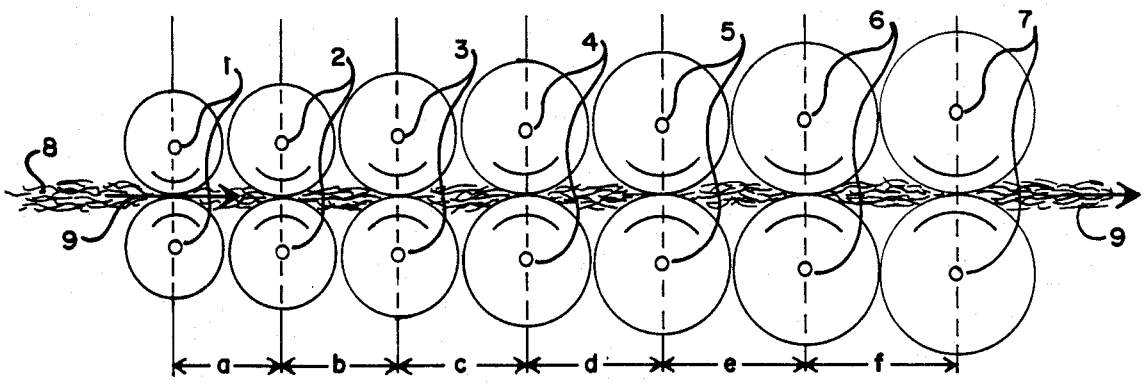
FIG. 1 is cross-sectional view of a graduated roll drafter.

FIG. 1 shows a cross-sectional view of a specific embodiment of the roll drafter of the instant invention, including a plurality of pairs of rolls designated 1–7. For purposes of the present disclosure, the terms "roll" and "roller" are synchronous. A minimum horizontal clearance, of for example 0.001 inch, is provided between adjacent pairs of rolls. Although seven pairs of rolls are shown in FIG. 1 for purposes of illustration, the present invention encompasses use of three or more pairs of rolls. It is preferred to utilize 7 to 10 pairs of rolls, and more preferred to utilize 8 to 10 pairs of rolls, e.g. 9 pairs of rolls. Numeral 8 designates the input strand or strip (also shown in FIG. 2) which is to be conducted between the pairs of rolls. The rolls are rotated by drive means such that, all top rolls rotate in a counter clockwise direction (as viewed in FIG. 1) as indicated by the upper arrows in FIG. 1, and all the bottom rolls rotate clockwise (as viewed in FIG. 1) as shown by the lower arrows in FIG. 1. In this manner the input strand or strip travels from left to right as viewed in FIGS. 1 and 2 in the direction of arrow 9. FIG. 1 includes vertical dashed lines extending through the centers of each roll of each pair of rolls, as well as through the nip defined between each pair of rolls. The distance between these dashed lines (i.e. the distances between the nips of adjacent pairs of rolls) are designated with the letters a to f. Said distances when viewed in the direction of strand or strip movement, gradually increase e.g. distance b is greater than distance a, distance c is greater than distance b, and so on for all roll pairs. This gradual increase in nip to nip distance may closely approximate the increase in fiber projected mean length as the strand or strip is drafted, thus the number of floating fibers is minimized and a superior drafted strand or strip is produced. Selection of nip spacings is somewhat dependent upon the lengths of the fibers being drafted i.e. for relatively longer fiber lengths larger nip spacings may be utilized, and for relatively shorter fiber lengths smaller nip spacings may be utilized. For example, for a one inch staple length fiber, it may be desirable to utilize nine pairs of rolls with nip to nip distances increasing from about 17/32 inch to about 31/32 inch in increments of about 2/32 inch.

Figure 2:
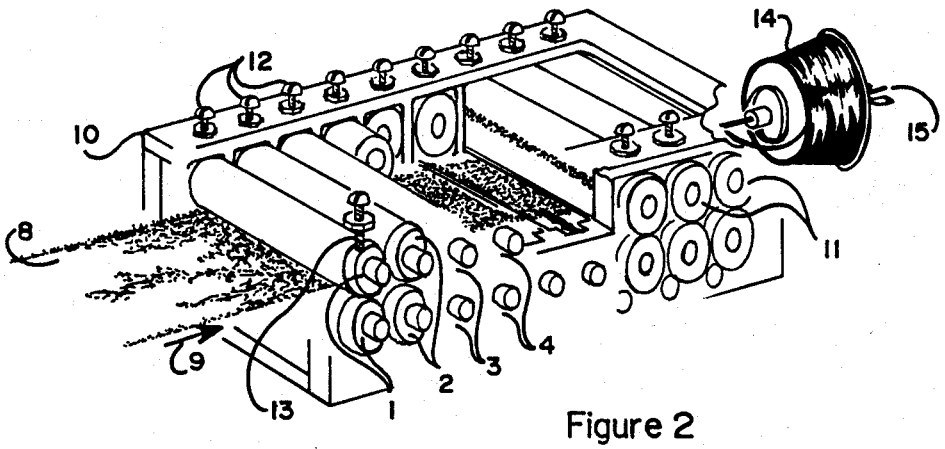
FIG. 2 shows a partial cut away view of a graduated roll drafter.

Optionally, as shown in FIGS. 1 and 2, the pairs of rolls may, when viewed in the direction of strand or strip movement, be of progressively increasing outer diameter, e.g. roll pair 2 may be of larger outer diameter than roll pair 1, roll pair 3 may be of larger outer diameter than roll pair 2, and so on for roll pairs. For example, using 9 pairs of rolls, the outer diameter is about ½ inch for the smaller roll pair, increasing in equal increments of about 1/16 inch to a largest outer diameter of about 1 inch.

FIG. 2 is a partial cut away view of an embodiment of the roller drafter of the present invention, including pairs of rolls 1, 2, 3, 4 and so on, of progressively increasing diameters, rotatably mounted on support means including, for example, a rigid frame 10 with minimum horizontal clearance (of for example about 0.001 inch) between adjacent pairs of rolls. The rolls may be geared together by intermeshed gears, a portion of the gears designated 11 is shown schematically in FIG. 2. The apparatus may also include adjusting means operatively connected to the rolls for adjusting roll position. For examle, as shown in FIG. 2, such adjusting means may be pressure adjusting screws 12 positioned above each end of each upper roll, for providing adjustable pressure to bearings 13 located at each end of each upper roll. Alternatively, the rolls may be spring loaded toward each other, or the upper rolls may be weight loaded against the lower rolls. All rolls may be driven at the same rotational speed which will provide a progressively increasing roll surface speed in the direction of strand or strip movement due only to the gradual increase of roll outer diameters. Alternatively, for example, where all rolls are of the same outer diameter, each pair of rolls may be separately driven at slightly higher rotational speed than the roll pair immediately before (as viewed in the direction of strip or strand movement) thereby providing a higher total draft as required. Also, when the rolls are all of the same outer diameter, means (such as a filler or cover) may be provided between pairs of rolls to prevent escape of fibers from between the pairs of rolls. The width of the rolls may be any mechanically feasible width, and may preferably be about ½ inches to 2 inches.

Figure 7:
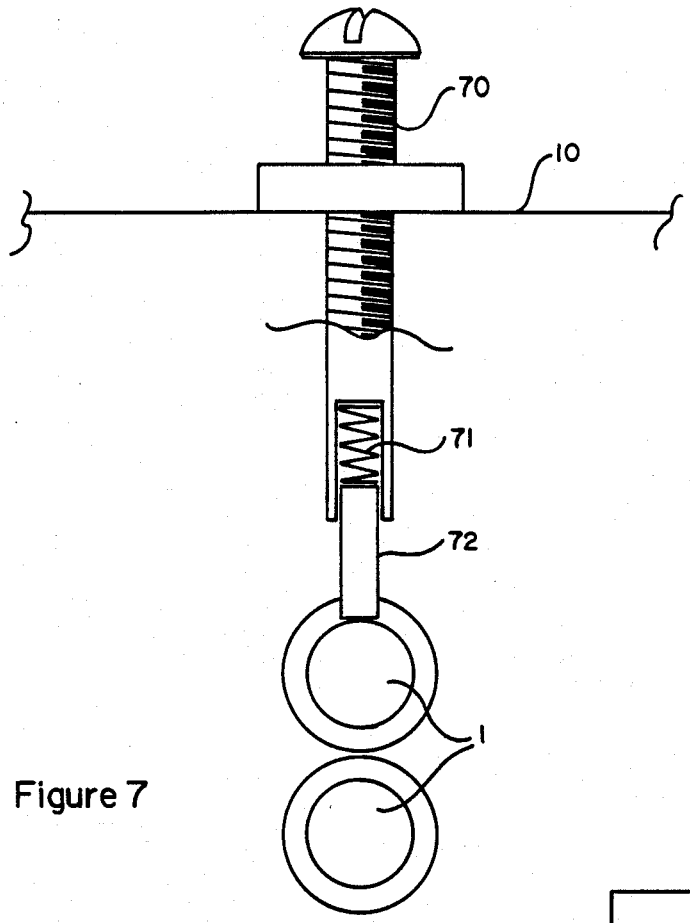
FIG. 7 is a partially cut away side view illustrating means for spring loading one roll against another roll.
Figure 8:
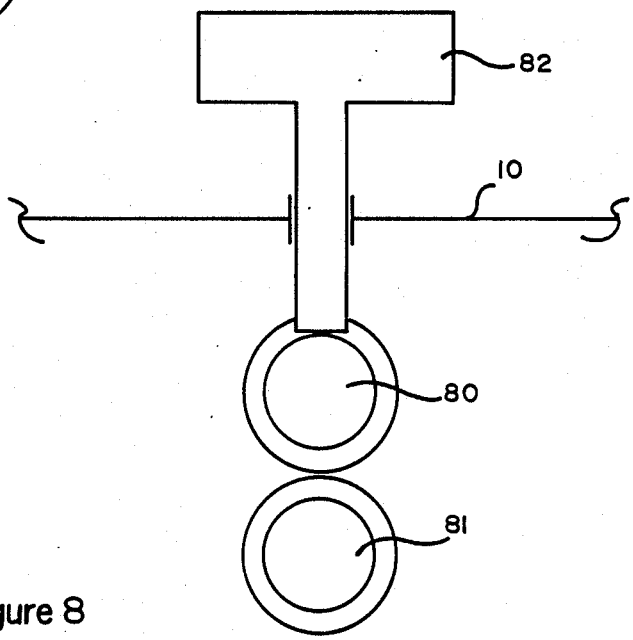
FIG. 8 is a side view showing an upper most roll weight loaded against another roll.

FIG. 7 illustrates means for spring loading one roll against another roll. As depicted in said figure, a portion of frame 10 has threaded therethrough a screw 70, a lower portion of which defines a cylindrical cavity in which is placed a coil spring 71. Said coil spring pushes a pin 72 which is slideably held in said cavity against a bearing of the upper roll of the pair of rolls designated 1, thereby providing spring loading of the upper roll against the lower roll. FIG. 8 illustrates weight loading which may be used in the present invention. Said figure shows a weight 82 slideably held in a portion of frame 10. The bottom of weight 82 rests on a bearing of upper roll 80, thereby weight loading upper roll 80 against lower roll 81.

Although hundreds of liquid binders were tested in an effort to improve yarn elongation, as described in Salaun, H. L., Jr., and Louis, G. L., A Progress Report—The SRRC No-Twist Yarn System, Am. Textiles Rep. Bull. 9(11), 36–40 (1980), the highest yarn elongation achieved was 4.95%. Therefore, a new approach to bind the parallelized fibers together was explored. This new approach includes binding the drafted fibers with a wrapping fiber from a rotating spool of wrapping fiber designated 14 in FIG. 2. This wrapping fiber may for example be a water soluble polyvinyl alcohol filament as described in Louis, Gain L. and Salaun, Harold L., "X" Direction Filament-Wrapped Yarn, Textile Res. J., 56, 161–163 (1986), although other wrapping fiber compositions such as polyester or rayon may be utilized. The finished yarn is designated by numeral 15. This filament-wrapping technique produces yarns with much higher elongation than the liquid binder method and proved to be highly efficient. When the wrapped yarn is made into knit fabric and washed, the polyvinyl alcohol comes off, leaving the yarn fiber assembly in the fabric without twist. Knit fabrics so constructed are very soft and water absorbent and have low air permeability.

Figure 3:
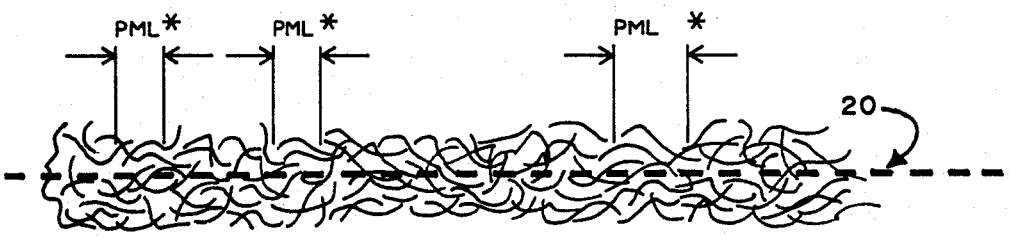
FIG. 3 shows a section of a card sliver and illustrates measurement of projected mean length.

In operation the input strand or strip of fibers (designated 8) is gradually stretched or drafted as individual fibers are accelerated to a higher velocity by each succeeding pair of rolls. Thus, the fibers are straightened and aligned more closely to the axis of the strand or strip. The projected mean length (PML) as shown in FIG. 3 which is the mean of the fiber lengths projected onto the central axis of the strand (designated 20), gradually increases as the strand or strip passes through each drafting zone. Typically, the projected mean length (PML) for a card web using 1 1/32 inch cotton which is 0.4 inch or 0.5 inch, will be increased to 0.8 inch to 0.9 inch by the drafting device of the present invention.

EXAMPLE

A long staple cotton having the following fiber properties was used: classer's grade—SM; fiber length; 2.5% span length (mm)—29.5%, 50% span length (mm)—14.7, Uniformity ratio (%)—50; fiber strength: 3.17 mm gauge (g/tex)—24.2; fiber elongation (%)—7.2; and micronaire reading—4.0. The cotton was processed through a conventional opening and picking line to form 434 g/m laps, which were then carded into 3.90 g/m sliver at 0.19 kg/second (25 pounds/hour). A number of these slivers were fed into the card to form a 50 mm wide card web strip from which the filament wrapped yarn was made. The number of slivers fed determined the size of the yarn as shown in Table 1. Four yarn production rates of 21, 32, 42, and 48 m/min were used in this experiment for each of the 4 yarn numbers.

TABLE I

The number of slivers fed determines the size of yarn.

| Number of sliver fed | Nominal yarn number, tex |
|---|---|
| 6 | 49 |
| 5 | 39 |
| 4 | 33 |
| 3 | 25 |

The polyvinyl alcohol (PVA) filament used was a multi-strand 40 denier yarn. The average amount of filament add-on ranged from 5% to 7% of the weight of yarn.

The card used to product the yarn was a standard flat-top cotton card equipped with metallic clothing on both cylinder and doffer. Crush-rolls were used. Speeds of various card components when operating at a yarn production rate of 48 m/min were: cylinder—436 radians/min. lickerin—1,036 radian/min, doffer—23 radians/min, flats—28 mm/min. The speed of the card components depends on the speed of the main cylinder of the card because it drives all other components.

The drafter utilized was a graduated roller drafter (GRD) having nine pairs of rolls of progressively increasing diameters, rotatably mounted in a rigid frame with 0.10 mm horizontal clearance between adjacent pairs. The roll diameters range from 12.7 mm to 25.4 mm in equal increments of 1.59 mm (1/16 inches). The rolls are geared together such that all top rolls rotate in a counterclockwise direction and all bottom rolls rotate in a clockwise direction. The top rolls are spring loaded against the bottom rolls. Since the gradual increase in nip-to-nip distances in this GRD closely approximates the increase in the projected mean length of the fiber as the strand is being drafted, strict fiber control is maintained.

Aligned fibers from this GRD are wrapped by a water soluble polyvinyl alcohol filament (PVA) as they emerge from between the top and bottom front rolls to form a wrapped yarn. The method of wrapping the fibrous cotton core with PVA filament is described in a previous publication, Louis, Gain L., and Salaun, Harold L., "X" Direction Filament-Wrapped Yarn, Textile Res. J. 56, 161–163 (1986). The wrapped yarn is then wound directly on to a plastic tube.

This experiment involves making four different yarn sizes at four different production rates and two levels of filament wrap per unit length, as shown in Table II.

TABLE II

Yarn sizes and production rates

| Yarn number, tex | Production rate, m/min | Wrap Factor |
|---|---|---|
| 25 | 21 | 33.5 |
| 33 | 32 | 43.1 |
| 39 | 42 | Not Measured |
| 48 | 48 | Not Measured |

The wrap factor is defined as follows: wrap factor=(wraps per cm)/(text)$^{\frac{1}{2}}$. Fiber and yarn evaluations were made in accordance with ASTM methods; as for example referred to in Amer. Soc. for Testing and Materials, "Annual Book of ASTM Standards", section 7, vols. 07.01 and 07.02, 1985. The Student t-test was used for statistical signficant difference analysis between lots of fibers and yarns at the 95% probability level.

The degree of fiber parallelization in terms of projected mean length for the card web and as produced by the graduated roller drafter are as shown in Table III.

TABLE III

Degree of fiber parallelization.

| Process | Projected mean length, mm | Projected Mean Length improvement % |
|---|---|---|
| Card web | 15.1 | — |
| Roller drafter | 19.1 | 26.5 |

The differences in projected mean length between the card web and the graduated roller drafted strand are statistically significant, indicating that the graduated roller drafter did straighten the web fibers significantly. The degrees of projected mean length improvement from card web to drafted strand produced by the graduated roller drafter is similar to that from card web to second-drawing sliver in conventional processing. Examination of the fiber length and length distributions of the card web and drafted strands also showed no significant difference, indicating that no fiber breakage occurred when the web was being drafted by the graduated roller drafter.

Figure 4:
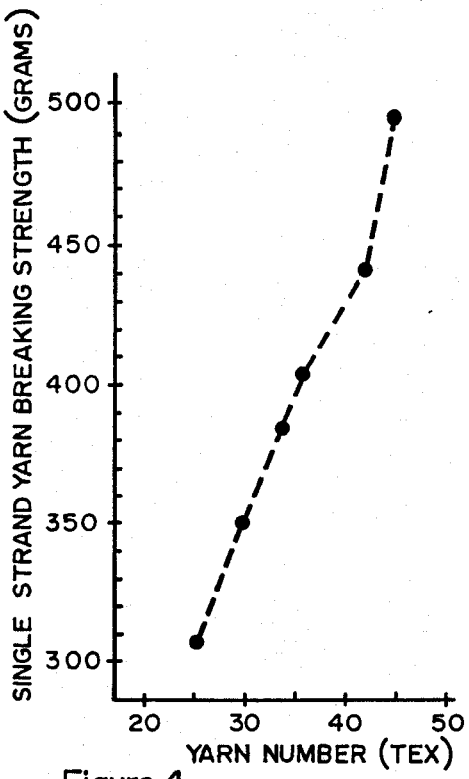
FIG. 4 is a graph of single strand yarn breaking strength (grams) versus yarn number (TEX) for yarn produced by the present invention.
Figure 5:
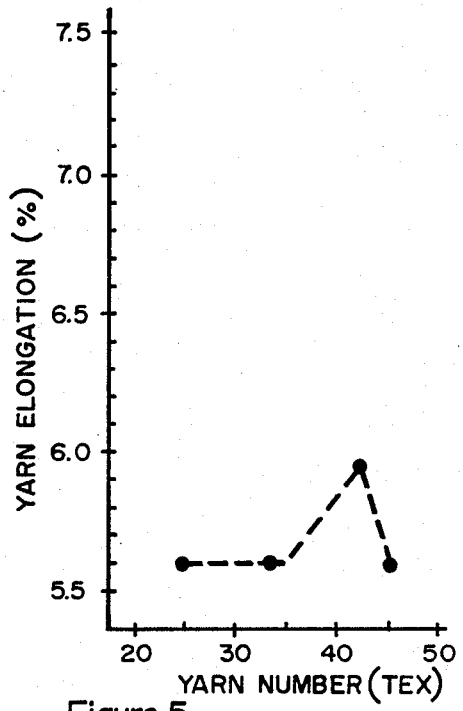
FIG. 5 is a graph of yarn elongation (%) versus yarn number (TEX) for yarn produced by the present invention.
Figure 6:
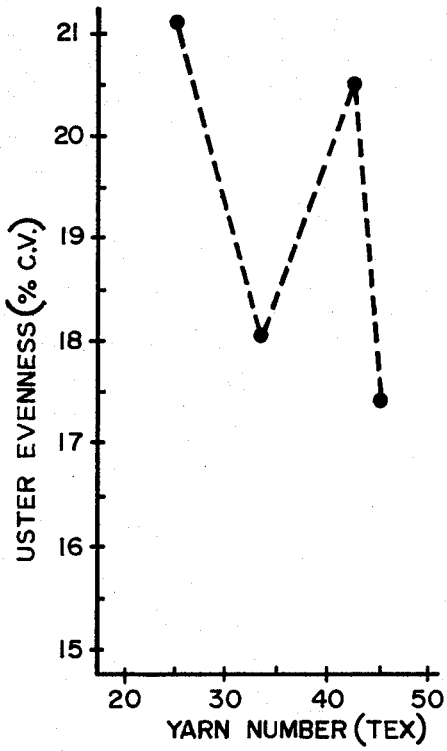
FIG. 6 is a graph of Uster evenness versus yarn number (TEX) for yarn produced by the present invention.

FIGS. 4, 5 and 6 show the properties of yarn produced by the graduated roller drafter. These yarns were made with a wrap factor of 43.1. As shown in FIGS. 4–6, all yarn breaking strengths increased with increasing yarn number.

The yarn appearance grade values of these yarns are given in Table IV.

TABLE IV

Yarn appearance grade values.

| Yarn number, tex | Yarn grade |
|---|---|
| 25 | C |
| 33 | B− |
| 39 | B− |
| 48 | B− |

The average amount of filament add-on ranged from 5% to 7% based on the weight of the yarn. The actual amount depends on the yarn number and amount of wraps per unit length of yarn. The wrapped yarn process eliminates two drawing processes, the roving process, conventional spinning, rewinding, and slashing. Savings from the elimination of these processes offsets the cost of the PVA filament, and if other filaments such as polyester or rayon are used for wrapping, the savings gained may be great.

We claim:

1. An apparatus for modifying a strand or strip of fibers including drafting of said strand or strip, comprising:

at least three pairs of rolls, support means operatively connected to said rolls for supporting each said pair of rolls so that the rolls of each pair are adjacent each other and define therebetween a nip, drive means operatively associated with said rolls for driving said rolls to rotate in a direction of strand or strip movement, wherein distances between nips of adjacent pairs of rolls increase in said direction of strand or strip movement, said rolls each define an outer diameter, both rolls of each pair of rolls define essentially the same outer diameter, and the outer diameter of each pair of rolls increases in said direction of strand or strip movement.

2. The apparatus of claim 1 wherein said drive means drives all said rolls at essentially the same rotational speed to provide progressively increasing roll surface speed due to said increasing roll outer diameter.

3. The apparatus of claim 1 including, nine pairs of said rolls defining outer diameters which gradually increase from about ½ inch to about 1 inch in equal increments of about 1/16 inch.

4. The apparatus of claim 3 wherein said distances between nips of adjacent pairs of rolls increase from about 17/32 inch to about 31/32 inch in increments of about 2/32 inch.

5. The apparatus of claim 1 including 7 to 10 pairs of said rolls.

6. The apparatus of claim 1 further including adjusting means operatively connected to said rolls for adjusting roll position.

7. The apparatus of claim 1 wherein said drive means includes gears connected to said rolls.

8. The apparatus of claim 1 wherein at least one pair of rolls includes means operatively connected thereto for spring loading one roll against another roll.

9. The apparatus of claim 1 wherein at least one pair of rolls includes an upper most roll which is weight loaded against another roll.

10. The apparatus of claim 1 wherein all said rolls define a width of from about 1½ to about 2 inches.

11. The apparatus of claim 1 further including operatively associated wrapping means for wrapping a drafted strand or strip with a wrapping fiber.

12. A process of modifying a strand or strip of fibers including drafting of said strand or strip comprising:

conducting a strand or strip of fibers in a direction of strand or strip movement successively between pairs of rolls of at least three pairs of rolls, each said pair of rolls defining between the rolls thereof a nip, adjusting the distances between nips of adjacent pairs of rolls to increase in said direction of strand or strip movement, said rolls each defining an outer diameter, both rolls of each pair of rolls defining essentially the same outer diameter, and the outer diameter of each pair of rolls increasing in said direction of strand or strip movement, to produce a drafted strand or strip.

13. The process of claim 12 further including the step of driving all said rolls at essentially the same rotational speed to provide progressively increasing roll surface speed due to said increasing roll outer diameter.

14. The process of either claim 12 or 13 wherein nine pairs of rolls are utilized and said outer diameters of each said pair of rolls gradually increases from about ½ to about 1 inch in equal increments of about 1/16 inch.

15. The process of claim 14 wherein the distances between nips of adjacent pairs of rolls increase from about 17/32 inch to about 31/32 inch in increments of about 2/32 inch.

16. The process of claim 12 wherein said at least three pairs of rolls is 7 to 10 pairs of rolls.

17. The process of claim 12 further including the step of adjusting roll position.

18. The process of claim 12 further including the step of driving at least a portion of said pairs of rolls utilizing gears connected to said at least a portion of said pairs of rolls.

19. The process of claim 12 further including the step of spring loading one roll of at least one of said pairs of rolls toward the other roll of that pair.

20. The process of claim 12 further including the step of weight loading one roll of at least one of said pairs of rolls toward the other roll of that pair.

21. The process of claim 12 wherein all said rolls define a width of from about 1½ inch to about 2 inches.

22. The process of claim 12 further including the step of wrapping said drafted strand or strip with a wrapping fiber.

23. The process of claim 22 wherein said wrapping fiber is of a composition selected from the group consisting of polyvinyl alcohol, polyester or rayon.

24. The process of claim 12 wherein said distances between nips of adjacent pairs of rolls are approximately equal to the projected mean length of fibers in said strand or strip.

25. A drafted strand or strip produced by the process of claim 12.

26. A wrapped yarn produced by the process of claim 22.

27. A wrapped yarn produced by the process of claim 23.

* * * * *